US010234175B2

(12) United States Patent
Oda et al.

(10) Patent No.: US 10,234,175 B2
(45) Date of Patent: Mar. 19, 2019

(54) TURBO REFRIGERATOR

(71) Applicant: DAIKIN INDUSTRIES, LTD., Osaka-shi, Osaka (JP)

(72) Inventors: Kentarou Oda, Tokyo (JP); Seiichiro Yoshinaga, Tokyo (JP); Nobuyoshi Sakuma, Tokyo (JP)

(73) Assignee: Daikin Industries, Ltd., Osaka-shi, Osaka (JP)

( * ) Notice: Subject to any disclaimer, the term of this patent is extended or adjusted under 35 U.S.C. 154(b) by 96 days.

(21) Appl. No.: 14/895,805

(22) PCT Filed: May 29, 2014

(86) PCT No.: PCT/JP2014/064305
§ 371 (c)(1),
(2) Date: Dec. 3, 2015

(87) PCT Pub. No.: WO2014/196454
PCT Pub. Date: Dec. 11, 2014

(65) Prior Publication Data

US 2016/0116190 A1 Apr. 28, 2016

(30) Foreign Application Priority Data

Jun. 4, 2013 (JP) ..... 2013-117736

(51) Int. Cl.
*F25B 1/053* (2006.01)
*F25B 31/00* (2006.01)
(Continued)

(52) U.S. Cl.
CPC ..... *F25B 1/053* (2013.01); *F25B 31/004* (2013.01); *F25B 31/008* (2013.01); *F25B 1/10* (2013.01);
(Continued)

(58) Field of Classification Search
CPC ..... F25B 1/053; F25B 25/005; F25B 31/004; F25B 31/006; F25B 31/026;
(Continued)

(56) References Cited

U.S. PATENT DOCUMENTS 3,407,623 A 10/1968 Richardson et al.
4,465,427 A * 8/1984 Libertini ..... F01D 25/18 384/398
(Continued)

FOREIGN PATENT DOCUMENTS

CN 201014825 Y 1/2008
JP 50-158253 U 12/1975
(Continued)

OTHER PUBLICATIONS

International Search Report, issued in PCT/JP2014/064305, dated Sep. 2, 2014.
(Continued)

*Primary Examiner* — Keith Raymond
*Assistant Examiner* — Kamran Tavakoldavani
(74) *Attorney, Agent, or Firm* — Birch, Stewart, Kolasch & Birch, LLP

(57) ABSTRACT

A turbo refrigerator is provided with: a turbo compressor having a motor; an oil cooling unit which cools lubricating oil which is supplied to at least a portion of the turbo compressor; a refrigerant introduction part which introduces some of the refrigerant which circulates between an evaporator and a condenser into a motor accommodation space and the oil cooling unit; and a cooling unit which cools the refrigerant which is introduced into the motor accommodation space and the oil cooling unit.

6 Claims, 2 Drawing Sheets

(51) Int. Cl.
*F25B 1/10* (2006.01)
*F25B 25/00* (2006.01)

(52) U.S. Cl.
CPC ..... *F25B 25/005* (2013.01); *F25B 2339/047* (2013.01); *F25B 2341/0016* (2013.01); *F25B 2341/0662* (2013.01); *F25B 2400/13* (2013.01); *F25B 2400/23* (2013.01); *F25B 2500/01* (2013.01)

(58) Field of Classification Search
CPC .. F25B 2341/0016; F04D 25/06; F04D 25/16; F04D 29/5806
See application file for complete search history.

(56) References Cited

U.S. PATENT DOCUMENTS 5,182,919 A 2/1993 Fujiwara
5,884,498 A * 3/1999 Kishimoto ..... F25B 1/053 62/172
6,182,467 B1 * 2/2001 Zhong ..... F04C 29/025 62/470
6,293,555 B1 * 9/2001 Sedy ..... F16J 15/38 277/379
8,833,102 B2 * 9/2014 Tsukamoto ..... F04D 17/12 417/244
9,541,310 B2 * 1/2017 Yokoyama ..... F25B 31/004
2007/0271938 A1 * 11/2007 Shaffer ..... F25B 27/00 62/228.1
2011/0243710 A1 * 10/2011 Kurihara ..... F04D 25/04 415/110
2011/0247357 A1 * 10/2011 Sugitani ..... F25B 1/053 62/498

FOREIGN PATENT DOCUMENTS

JP 2001-349628 A 12/2001
JP 2002-322999 A 11/2002
JP 2007-212112 A 8/2007
JP 59-49850 U 1/2008
JP 2008-14577 A 1/2008
JP 2009-186029 A 8/2009
JP 2011-137402 A 7/2011
JP 2012-78036 A 4/2012

OTHER PUBLICATIONS

Extended European Search Report, dated Feb. 25, 2017, for European Application No. 14807016.2.

* cited by examiner

TURBO REFRIGERATOR

TECHNICAL FIELD

The present invention relates to a turbo refrigerator.

Priority is claimed on Japanese Patent Application No. 2013-117736, filed on Jun. 4, 2013, the content of which is incorporated herein by reference.

BACKGROUND ART

In a turbo refrigerator which is provided with a turbo compressor which is driven by a motor, for example, the cooling of the motor is performed by supplying some of a refrigerant which circulates between an evaporator and a condenser to the motor (refer to, for example, Patent Document 1). Furthermore, in a turbo refrigerator as disclosed in Patent Document 1, usually, lubricating oil is always supplied to a gear or the like which connects a rotating shaft of a motor and an impeller, and the lubricating oil is cooled by a heat exchange with the refrigerant and then supplied to the gear or the like, thereby cooling the gear or the like.

Patent Document 2 discloses a technique of integrating an intermediate cooler which is provided between a condenser and an evaporator and supplies some of a refrigerant liquefied in the condenser to a turbo compressor, with a motor for the driving of the turbo compressor.

Patent Document 3 discloses a pressure equalizer which connects an oil tank storing lubricating oil and a compression mechanism which is a space in which an intake capacity control section (an inlet guide vane) for controlling the capacity of a refrigerant passing through a turbo compressor, and a low-stage compression section and a high-stage compression section of the turbo compressor are installed.

CITATION LIST

Patent Document

[Patent Document 1] Japanese Unexamined Patent Application, First Publication No. 2007-212112

[Patent Document 2] Japanese Unexamined Patent Application, First Publication No. 2001-349628

[Patent Document 3] Japanese Unexamined Patent Application, First Publication No. 2009-186029

SUMMARY OF INVENTION

Technical Problem

As it is well known, a turbo refrigerator is a type of heat pump. However, in recent years, in order to obtain hot water having a high temperature, a technique of using such a turbo refrigerator in a higher temperature area than that of a conventional turbo refrigerator has been proposed. For example, in a conventional turbo refrigerator, the temperature of a refrigerant in an evaporator in which a temperature becomes lowest is in the magnitude of several ° C. However, in a turbo refrigerator which is used in a high temperature area as described above, the temperature of a refrigerant in an evaporator becomes a magnitude of several tens of ° C., and thus a temperature in a condenser becomes higher. For this reason, there is a possibility that a motor or lubricating oil may not be able to be sufficiently cooled.

The present invention has been made in view of the above-described circumstances and has an object to sufficiently cool a motor and lubricating oil in a turbo refrigerator.

Solution to Problem

According to a first aspect of the present invention, a turbo refrigerator is provided including: a turbo compressor having a motor; an oil cooling unit which cools lubricating oil which is supplied to at least a portion of the turbo compressor; a refrigerant introduction part which introduces some of a refrigerant which circulates between an evaporator and a condenser into a motor accommodation space and the oil cooling unit; and a cooling unit which cools the refrigerant which is introduced into the motor accommodation space and the oil cooling unit, wherein the cooling unit is a compressor which decompresses the insides of the motor accommodation space and the oil cooling unit, thereby cooling the refrigerant which is introduced into the motor accommodation space and the oil cooling unit, and recovers the refrigerant from the insides of the motor accommodation space and the oil cooling unit and then returns the refrigerant to the evaporator.

According to a second aspect of the present invention, in the first aspect, the turbo refrigerator further includes: an oil returning unit which returns the lubricating oil accumulated in the motor accommodation space to an oil tank in which the lubricating oil is stored.

According to a third aspect of the present invention, in the second aspect, the oil returning unit is an ejector which moves the lubricating oil by using a compressed refrigerant gas produced by the turbo compressor.

According to a fourth aspect of the present invention, in any one of the first to third aspects, the turbo refrigerator further includes: a bearing which rotatably supports a rotating shaft of the motor; a first non-contact sealing mechanism and a second non-contact sealing mechanism which are disposed further toward the rotor side of the motor than the bearing and arranged in an axial direction of the rotating shaft; and a compressed gas supply part which supplies some of the compressed refrigerant gas produced by the turbo compressor between the first non-contact sealing mechanism and the second non-contact sealing mechanism.

According to a fifth aspect of the present invention, in the first aspect, the cooling unit is provided with a sub-refrigerator which cools the refrigerant which is introduced into the motor and the oil cooling unit.

Advantageous Effects of Invention

According to the present invention, the refrigerant which is introduced into the motor accommodation space and the oil cooling unit is cooled by the cooling unit. Therefore, according to the present invention, even in a case where the temperature of the refrigerant in the condenser is not sufficiently low, the temperature of the refrigerant is lowered by the cooling unit, and thus it is possible to sufficiently cool the motor and the lubricating oil.

DESCRIPTION OF EMBODIMENTS

Hereinafter, embodiments of a turbo refrigerator according to the present invention will be described with reference to the drawings. In addition, in the following drawings, in order to show each member in a recognizable size, the scale of each member is appropriately changed.

(First Embodiment)

Figure 1:
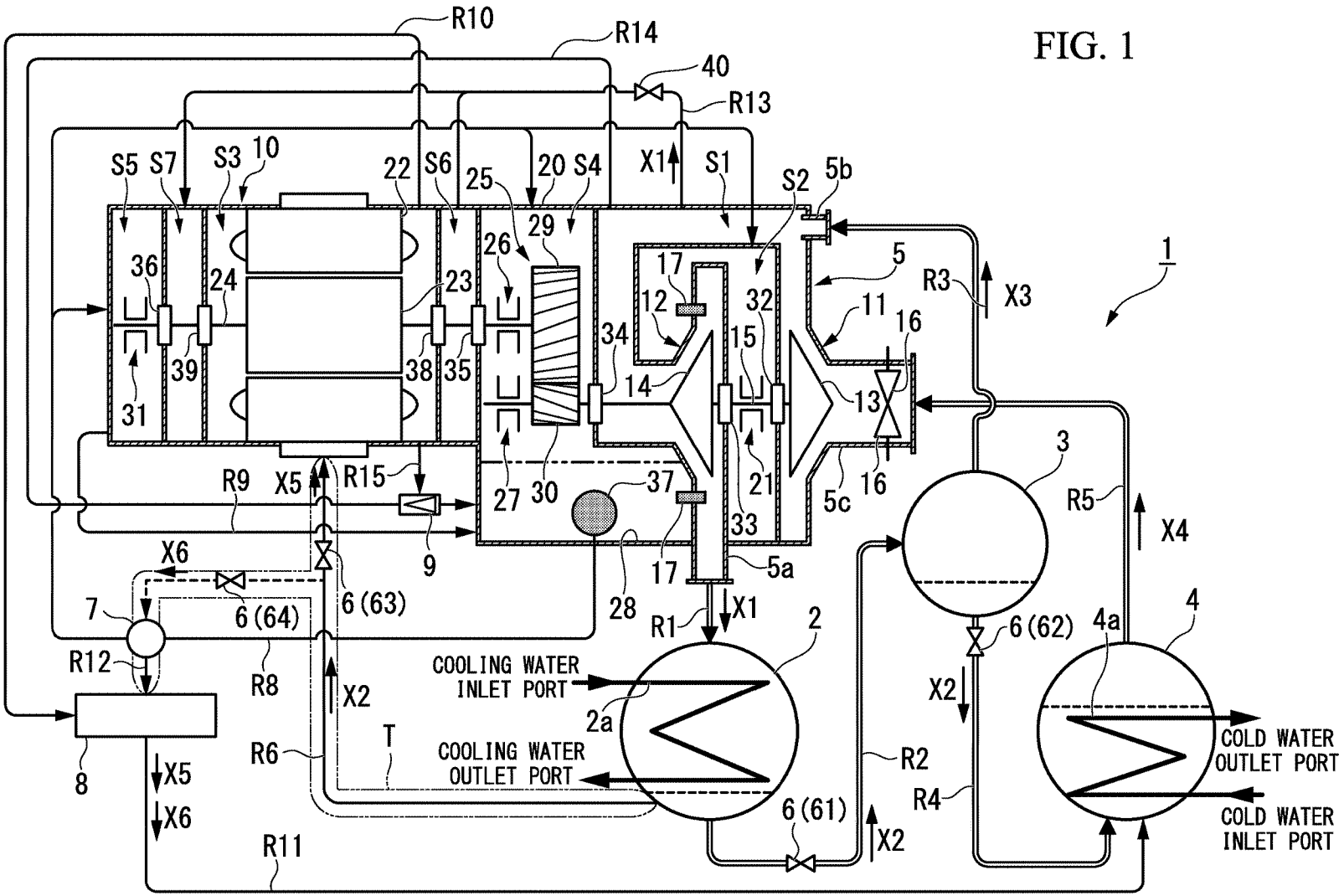
FIG. 1 is a system diagram of a turbo refrigerator in a first embodiment of the present invention.

FIG. 1 is a system diagram of a turbo refrigerator 1 in a first embodiment of the present invention. The turbo refrigerator 1 is provided with a condenser 2, an economizer 3, an evaporator 4, a turbo compressor 5, an expansion valve 6, an oil cooler 7 (an oil cooling unit), a small compressor 8 (a cooling unit), and an ejector 9 (an oil returning unit), as shown in FIG. 1.

The condenser 2 is connected to a gas discharge pipe 5*a* of the turbo compressor 5 through a flow path R1. A refrigerant (a compressed refrigerant gas X1) compressed by the turbo compressor 5 is supplied to the condenser 2 through the flow path R1. The condenser 2 liquefies the compressed refrigerant gas X1. The condenser 2 is provided with a heat exchanger tube 2*a* through which cooling water flows, and cools and liquefies the compressed refrigerant gas X1 by heat exchange between the compressed refrigerant gas X1 and the cooling water t. In addition, as such a refrigerant, a chlorofluorocarbon or the like can be used.

The compressed refrigerant gas X1 is cooled and liquefied by heat exchange between itself and the cooling water, thereby becoming a refrigerant liquid X2, and the refrigerant liquid X2 accumulates in a bottom portion of the condenser 2. The bottom portion of the condenser 2 is connected to the economizer 3 through a flow path R2. The expansion valve 6 (a first expansion valve 61), for decompressing the refrigerant liquid X2, is provided in the flow path R2. The refrigerant liquid X2 decompressed by the first expansion valve 61 is supplied to the economizer 3 through the flow path R2.

The economizer 3 temporarily stores the decompressed refrigerant liquid X2 and separates the refrigerant into a liquid phase and a gas phase. A top portion of the economizer 3 is connected to an economizer connecting pipe 5*b* of the turbo compressor 5 through a flow path R3. A gas-phase component X3 of the refrigerant separated out by the economizer 3 is supplied to a second compression stage 12 (described later) through the flow path R3 without passing through the evaporator 4 and a first compression stage 11 (described later), and thus the efficiency of the turbo compressor 5 is increased. On the other hand, a bottom portion of the economizer 3 is connected to the evaporator 4 through a flow path R4. The expansion valve 6 (a second expansion valve 62), for further decompressing the refrigerant liquid X2, is provided in the flow path R4. The refrigerant liquid X2 further decompressed by the second expansion valve 62 is supplied to the evaporator 4 through the flow path R4.

The evaporator 4 evaporates the refrigerant liquid X2 and cools cold water using the heat of vaporization.

The evaporator 4 is provided with a heat exchanger tube 4*a* through which the cold water flows, and causes the cooling of the cold water and the evaporation of the refrigerant liquid X2 by heat exchange between the refrigerant liquid X2 and the cold water. The refrigerant liquid X2 evaporates by taking in heat by heat exchange between itself and the cold water, thereby becoming a refrigerant gas X4. A top portion of the evaporator 4 is connected to a gas suction pipe 5*c* of the turbo compressor 5 through a flow path R5. The refrigerant gas X4 having evaporated in the evaporator 4 is supplied to the turbo compressor 5 through the flow path R5.

The turbo compressor 5 compresses the refrigerant gas X4 having evaporated and supplies it to the condenser 2 as the compressed refrigerant gas X1. The turbo compressor 5 is a two-stage compressor which is provided with the first compression stage 11 which compresses the refrigerant gas X4, and the second compression stage 12 which further compresses the refrigerant compressed in one step.

An impeller 13 is provided in the first compression stage 11, an impeller 14 is provided in the second compression stage 12, and these impellers are connected by a rotating shaft 15. The turbo compressor 5 has a motor 10 and compresses the refrigerant by rotating the impeller 13 and the impeller 14 by the motor 10. Each of the impeller 13 and the impeller 14 is a radial impeller and radially leads out the refrigerant suctioned in an axial direction.

An inlet guide vane 16 for regulating the intake amount of the first compression stage 11 is provided in the gas suction pipe 5*c*. The inlet guide vane 16 is made to be rotatable such that an apparent area from a flow direction of the refrigerant gas X4 can be changed. A diffuser flow path is provided around each of the impeller 13 and the impeller 14, and the refrigerant led out in a radial direction is compressed and increased in pressure in the diffuser flow path. Furthermore, it is possible to supply the refrigerant to the next compression stage by a scroll flow path provided around the diffuser flow path. An outlet throttle valve 17 is provided around the impeller 14 and can control the discharge amount from the gas discharge pipe 5*a*.

The turbo compressor 5 is provided with a hermetic type housing 20. The inside of the housing 20 is partitioned into a compression flow path space S1, a first bearing accommodation space S2, a motor accommodation space S3, a gear unit accommodation space S4, a second bearing accommodation space S5, a first compressed gas supply space S6, and a second compressed gas supply space S7.

The impeller 13 and the impeller 14 are provided in the compression flow path space S1. The rotating shaft 15 connecting the impeller 13 and the impeller 14 is provided to pass through the compression flow path space S1, the first bearing accommodation space S2, and the gear unit accommodation space S4. A bearing 21 supporting the rotating shaft 15 is provided in the first bearing accommodation space S2.

A stator 22, a rotor 23, and a rotating shaft 24 connected to the rotor 23 are provided in the motor accommodation space S3. The rotating shaft 24 is provided to pass through the motor accommodation space S3, the gear unit accommodation space S4, the second bearing accommodation space S5, the first compressed gas supply space S6, and the second compressed gas supply space S7. A bearing 31 supporting the anti-load side of the rotating shaft 24 is provided in the second bearing accommodation space S5. A gear unit 25, a bearing 26, a bearing 27, and an oil tank 28 are provided in the gear unit accommodation space S4.

The gear unit 25 has a large-diameter gear 29 which is fixed to the rotating shaft 24, and a small-diameter gear 30 which is fixed to the rotating shaft 15 and engaged with the large-diameter gear 29. The gear unit 25 transmits a rotating force such that the rotational frequency of the rotating shaft 15 increases with respect to the rotational frequency of the rotating shaft 24 (the rotational speed of the rotating shaft 15 increases). The bearing 26 supports the rotating shaft 24. The bearing 27 supports the rotating shaft 15. The oil tank 28 stores lubricating oil which is supplied to each of the sliding sites, i.e., the bearing 21, the bearing 26, the bearing 27, and the bearing 31.

The first compressed gas supply space S6 is provided between the motor accommodation space S3 and the gear unit accommodation space S4. The second compressed gas supply space S7 is provided between the motor accommodation space S3 and the second bearing accommodation space S5. A flow path R13 (described later) is connected to the first compressed gas supply space S6 and the second compressed gas supply space S7 and the compressed refrigerant gas X1 is supplied thereto through flow path R13.

A sealing mechanism 32 and a sealing mechanism 33 which seal the periphery of the rotating shaft 15 are provided in the housing 20 between the compression flow path space S1 and the first bearing accommodation space S2. Furthermore, a sealing mechanism 34 which seals the periphery of the rotating shaft 15 is provided in the housing 20 between the compression flow path space S1 and the gear unit accommodation space S4. Furthermore, a sealing mechanism 35 which seals the periphery of the rotating shaft 24 is provided in the housing 20 between the gear unit accommodation space S4 and the first compressed gas supply space S6. Furthermore, a sealing mechanism 36 which seals the periphery of the rotating shaft 24 is provided in the housing 20 between the second bearing accommodation space S5 and the second compressed gas supply space S7. Furthermore, a sealing mechanism 38 which seals the periphery of the rotating shaft 24 is provided in the housing 20 between the motor accommodation space S3 and the first compressed gas supply space S6. Furthermore, a sealing mechanism 39 which seals the periphery of the rotating shaft 24 is provided in the housing 20 between the motor accommodation space S3 and the second compressed gas supply space S7.

Each of the sealing mechanism 32, the sealing mechanism 33, the sealing mechanism 34, the sealing mechanism 35, the sealing mechanism 36, the sealing mechanism 38, and the sealing mechanism 39 is a non-contact sealing mechanism which performs sealing in a non-contact manner, and is composed of a sealing mechanism having, for example, a labyrinth structure. Among them, the sealing mechanism 35 which is disposed between the gear unit accommodation space S4 and the first compressed gas supply space S6, and the sealing mechanism 38 which is disposed between the motor accommodation space S3 and the first compressed gas supply space S6 are equivalent to a first non-contact sealing mechanism and a second non-contact sealing mechanism in the present invention. That is, the sealing mechanism 35 and the sealing mechanism 38 function as a first non-contact sealing mechanism and a second non-contact sealing mechanism which are disposed further toward the rotor 23 side of the motor 10 than the bearing 26 and arranged in an axial direction of the rotating shaft 24. Furthermore, the sealing mechanism 36 which is disposed between the second bearing accommodation space S5 and the second compressed gas supply space S7, and the sealing mechanism 39 which is disposed between the motor accommodation space S3 and the second compressed gas supply space S7 are also likewise equivalent to the first non-contact sealing mechanism and the second non-contact sealing mechanism in the present invention.

The motor accommodation space S3 is connected to the condenser 2 through a flow path R6. The expansion valve 6 (a third expansion valve 63) is installed just before the motor accommodation space S3 of the flow path R6. A refrigerant gas X5 which is generated by decompressing the refrigerant liquid X2 taken out from the condenser 2 by the third expansion valve 63 is supplied to the motor accommodation space S3. The refrigerant gas X5 supplied to the motor accommodation space S3 cools the motor 10 accommodated in the motor accommodation space S3. Furthermore, the flow path R6 is branched and connected to the oil cooler 7. The expansion valve 6 (a fourth expansion valve 64) is installed just before the oil cooler 7 of the flow path R6.

The flow path R6 functions as a refrigerant introduction part T in the present invention, which introduces some of the refrigerant which circulates between the evaporator 4 and the condenser 2 into the motor accommodation space S3 and the oil cooler 7. Furthermore, the third expansion valve 63 and the fourth expansion valve 64 adjust the pressure in the motor accommodation space S3 and the saturation pressure in the oil cooler 7, thereby adjusting the temperature in the motor accommodation space S3 and the temperature of the inside of the oil cooler 7.

An oil feed pump 37 is disposed in the oil tank 28. The oil feed pump 37 is connected to the second bearing accommodation space S5 through, for example, a flow path R8. The lubricating oil is supplied from the oil tank 28 to the second bearing accommodation space S5 through the flow path R8. The lubricating oil supplied to the second bearing accommodation space S5 is supplied to the bearing 31 and thus secures the lubricity of a sliding site of the rotating shaft 24 and simultaneously reducing (cooling) generation of heat at the sliding site. The second bearing accommodation space S5 is connected to the oil tank 28 through a flow path R9. The lubricating oil supplied to the second bearing accommodation space S5 returns to the oil tank 28 through the flow path R9. Furthermore, the flow path R8 is also connected to the first bearing accommodation space S2 and the gear unit accommodation space S4, and thus the lubricating oil is also supplied to the bearing 21, the gear unit 25, the bearing 26, and the bearing 27. Furthermore, the lubricating oil supplied to the first bearing accommodation space S2 and the gear unit accommodation space S4 returns to the oil tank 28 through a flow path in the housing 20.

The oil cooler 7 is installed at a site in the middle of the flow path R8. A refrigerant gas X6 which is generated by decompressing the refrigerant liquid X2 taken out from the condenser 2 by the fourth expansion valve 64 is supplied into the oil cooler 7. The oil cooler 7 performs heat exchange between the lubricating oil which flows through the flow path R8 and the refrigerant gas X6 which is supplied thereto through the flow path R6, thereby cooling the lubricating oil which is supplied to the turbo compressor 5.

The small compressor 8 is a compressor smaller than the turbo compressor 5 and is connected to the motor accommodation space S3 through a flow path R10. The small compressor 8 decompresses the motor accommodation space S3 such that the temperature of the refrigerant gas X5 which is introduced into the motor accommodation space S3 becomes a temperature suitable for the cooling of the motor 10. That is, in this embodiment, the small compressor 8 performs the cooling of the refrigerant gas X5 which is supplied to the motor accommodation space S3. Furthermore, the small compressor 8 recovers the refrigerant gas X5 from the motor accommodation space S3 through the flow path R10 and returns the recovered refrigerant gas X5 to the evaporator 4 through a flow path R11.

Furthermore, the small compressor 8 is connected to the oil cooler 7 through a flow path R12 and decompresses the inside of the oil cooler 7, to which the refrigerant gas X6 for the oil cooler 7 is supplied, such that the temperature of the refrigerant gas X6 which is introduced into the oil cooler 7 becomes a temperature suitable for the cooling of the lubricating oil. That is, in this embodiment, the small compressor 8 performs the cooling of the refrigerant gas X6 which is supplied into the oil cooler 7. Furthermore, the small compressor 8 recovers the refrigerant gas X6 from the inside of the oil cooler 7 through the flow path R12 and returns the recovered refrigerant gas X6 to the evaporator 4 through the flow path R11.

In the turbo refrigerator 1 of this embodiment, the first compressed gas supply space S6 and the second compressed gas supply space S7 are connected to the compression flow path space S1 through the flow path R13 (a compressed gas supply part). The flow path R13 supplies some of the compressed refrigerant gas X1 produced in the turbo compressor 5 to the first compressed gas supply space S6 and the second compressed gas supply space S7. In this manner, the compressed refrigerant gas X1 is supplied to the first compressed gas supply space S6 and the second compressed gas supply space S7, whereby the compressed refrigerant gas X1 is supplied between the sealing mechanism 35 and the sealing mechanism 38 and between the sealing mechanism 36 and the sealing mechanism 39. That is, in this embodiment, the flow path R13 functions as a compressed gas supply part which supplies some of the compressed refrigerant gas produced by the turbo compressor 5 between the first non-contact sealing mechanism (the sealing mechanism 35 and the sealing mechanism 36) and the second non-contact sealing mechanism (the sealing mechanism 38 and the sealing mechanism 39). Furthermore, a flow rate adjusting valve 40 is provided in a site in the middle of the flow path R13, and thus the flow rate of the compressed refrigerant gas which is supplied to the first compressed gas supply space S6 and the second compressed gas supply space S7 can be adjusted.

The ejector 9 (the oil returning unit) is provided in a site in the middle of a flow path R14 connecting the compression flow path space S1 and the oil tank 28 and is connected to a bottom portion of the motor accommodation space S3 through a flow path R15. The ejector 9 moves the lubricating oil accumulated in the bottom portion of the motor accommodation space S3 to the oil tank 28 through the flow path R15 by using the static pressure of the compressed refrigerant gas X1 which flows through the flow path R14. The ejector 9 functions as the oil returning unit in the present invention, which returns the lubricating oil accumulated in the motor accommodation space S3 to the oil tank in which the lubricating oil is stored.

In the turbo refrigerator 1 of this embodiment having such a configuration, the compressed refrigerant gas X1 is cooled and condensed by the cooling water in the condenser 2, and the cooling water is heated, whereby heat is exhausted. The refrigerant liquid X2 produced by the condensation in the condenser 2 is decompressed by the first expansion valve 61 and then supplied to the economizer 3, and after the gas-phase component X3 is separated out, the refrigerant liquid X2 is further decompressed by the second expansion valve 62 and then supplied to the evaporator 4. The gas-phase component X3 is supplied to the turbo compressor 5 through the flow path R3.

The refrigerant liquid X2 supplied to the evaporator 4 evaporates in the evaporator 4, thereby taking in heat of the cold water and thus cooling the cold water. In this way, the heat of the cold water before cooling is substantially transported to the cooling water which is supplied to the condenser 2. The refrigerant gas X4 produced due to the evaporation of the refrigerant liquid X2 is supplied to the turbo compressor 5, thereby being compressed, and is then supplied to the condenser 2 again.

Furthermore, some of the refrigerant liquid X2 accumulated in the condenser 2 is supplied to the motor accommodation space S3 and the oil cooler 7 through the flow path R6. The insides of the motor accommodation space S3 and the oil cooler 7 are decompressed by the small compressor 8. For this reason, the refrigerant liquid X2 which is introduced into the motor accommodation space S3 through the flow path R6 becomes the refrigerant gas X5 by going through the third expansion valve 63 and cooled to a temperature suitable for cooling the motor 10. As a result, the motor 10 is sufficiently cooled. Furthermore, the refrigerant liquid X2 which is introduced into the oil cooler 7 through the flow path R6 becomes the refrigerant gas X6 by going through the fourth expansion valve 64 and cooled to a temperature suitable for cooling the lubricating oil. As a result, the lubricating oil flowing through the flow path R8 is sufficiently cooled in the oil cooler 7. In this way, the refrigerant gas X5 having cooled the motor 10 and the refrigerant gas X6 having cooled the lubricating oil are suctioned into the small compressor 8, thereby being recovered, and are returned to the evaporator 4 through the flow path R11.

Furthermore, the lubricating oil flowing through the flow path R8 is supplied to the first bearing accommodation space S2, the second bearing accommodation space S5, and the gear unit accommodation space S4, thereby reducing the sliding resistance of the bearing 21, the gear unit 25, or the like and further cooling the bearing 21, the gear unit 25, or the like.

Furthermore, the compressed refrigerant gas X1 produced in the turbo compressor 5 is supplied to the first compressed gas supply space S6 and the second compressed gas supply space S7 through the flow path R13. In this manner, the compressed refrigerant gas X1 is supplied to the first compressed gas supply space S6 and the second compressed gas supply space S7, whereby the compressed refrigerant gas X1 is supplied between the sealing mechanism 35 and the sealing mechanism 38 and between the sealing mechanism 36 and the sealing mechanism 39. The compressed refrigerant gas X1 is supplied, whereby the internal pressures of the first compressed gas supply space S6 and the second compressed gas supply space S7 becomes higher than that in the gear unit accommodation space S4 or the second bearing accommodation space S5. As a result, it becomes difficult for the lubricating oil supplied to the gear unit accommodation space S4 or the second bearing accommodation space S5, to enter the first compressed gas supply space S6 and the second compressed gas supply space S7 through slight gaps of the sealing mechanism 35 and the sealing mechanism 36.

Furthermore, some of the compressed refrigerant gas X1 flowing through the compression flow path space S1 is supplied to the oil tank 28 having a lower internal pressure than the compression flow path space S1 through the flow path R14. The lubricating oil accumulated in the motor accommodation space S3 is suctioned by the ejector 9 provided in the site in the middle of the flow path R14 and is moved to the oil tank 28.

According to the turbo refrigerator 1 of this embodiment as described above, the refrigerant gas X5 which is introduced into the motor accommodation space S3 and the refrigerant gas X6 which is introduced into the oil cooler 7 are cooled by the small compressor 8. Therefore, according to the turbo refrigerator 1 of this embodiment, even in a case where the temperature of the refrigerant liquid X2 in the condenser 2 is not sufficiently low, it is possible to lower the temperature of the refrigerant by the small compressor 8, and thus it is possible to sufficiently cool the motor 10 and the lubricating oil.

Furthermore, according to the turbo refrigerator 1 of this embodiment, the temperature of the refrigerant gas X6 is lowered by using the small compressor 8. For this reason, it is possible to lower the temperature of the refrigerant with a simple configuration, and thus it is possible to sufficiently cool the motor 10 and the lubricating oil.

Furthermore, according to the turbo refrigerator 1 of this embodiment, the ejector 9 which returns the lubricating oil accumulated in the motor accommodation space S3 to the oil tank 28 in which the lubricating oil is stored is provided. In this embodiment, the motor accommodation space S3 is decompressed by the small compressor 8, and therefore, it is easy for the lubricating oil to flow from the gear unit accommodation space S4 or the second bearing accommodation space S5 into the motor accommodation space S3. In contrast, the ejector 9 is provided, whereby it is possible to discharge the lubricating oil accumulated in the motor accommodation space S3 and return the lubricating oil to the oil tank 28, and thus it is possible to suppress a decrease in the lubricating oil, or the like.

Furthermore, it is also possible to discharge the lubricating oil accumulated in the motor accommodation space S3 by a pump. However, in this case, when the lubricating oil is not accumulated in the motor accommodation space S3, there is a possibility such as the pump idling. In contrast, the lubricating oil is discharged from the motor accommodation space S3 by using the ejector 9, whereby even when the lubricating oil is not accumulated in the motor accommodation space S3, it is possible to prevent the possibility from occurring.

Furthermore, according to the turbo refrigerator 1 of this embodiment, the compressed refrigerant gas X1 is supplied between the sealing mechanism 35 and the sealing mechanism 38 and between the sealing mechanism 36 and the sealing mechanism 39. As a result, it becomes difficult for the lubricating oil supplied to the gear unit accommodation space S4 or the second bearing accommodation space S5 to enter the first compressed gas supply space S6 and the second compressed gas supply space S7 through the slight gaps of the sealing mechanism 35 and the sealing mechanism 36. Accordingly, according to the turbo refrigerator 1 of this embodiment, it is possible to suppress a decrease in the lubricating oil, or the like.

(Second Embodiment)

Next, a second embodiment of the present invention will be described. In addition, in the description of this embodiment, with respect to the same portions as those of the first embodiment described above, description thereof is omitted or simplified.

Figure 2:
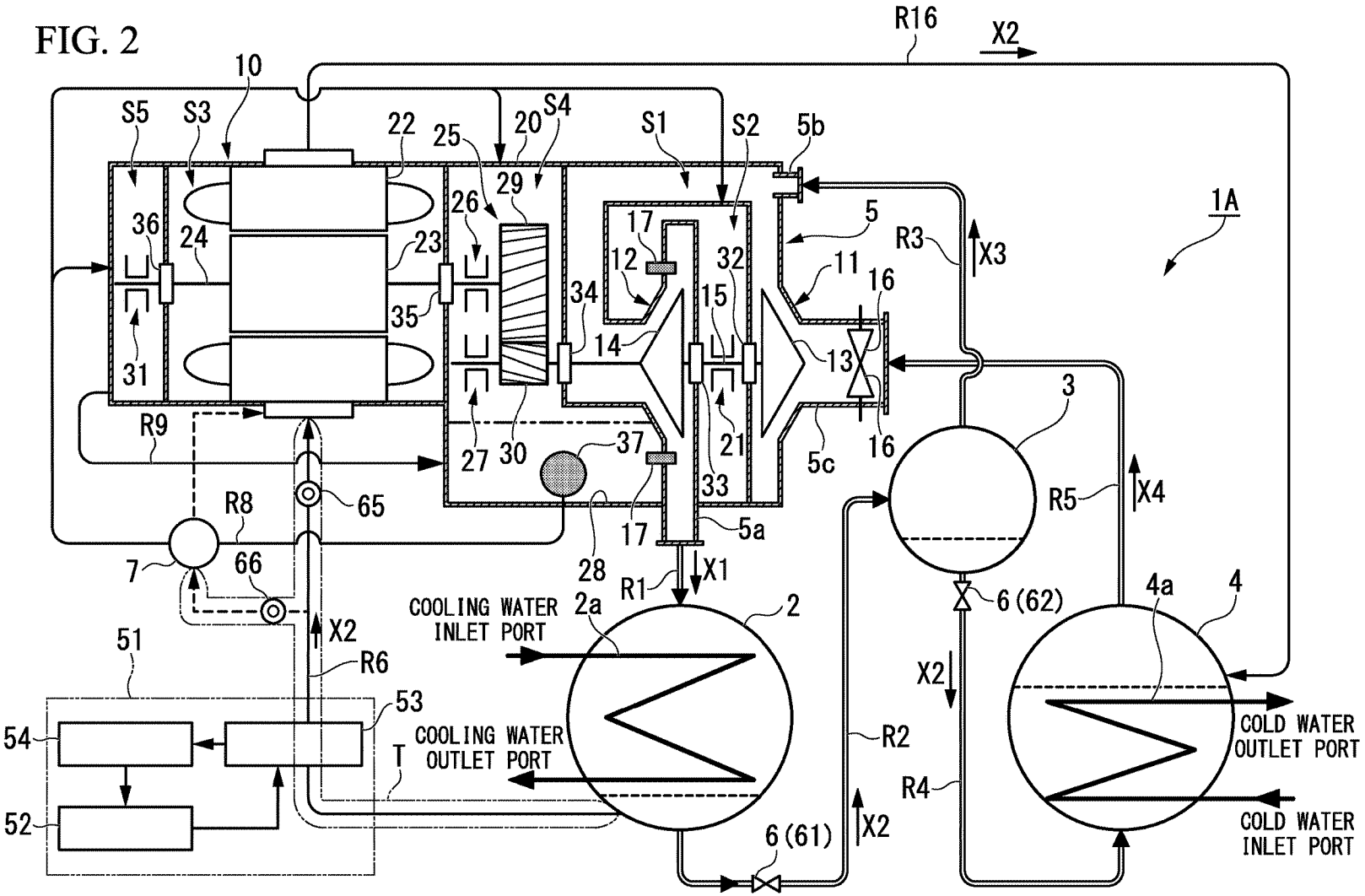
FIG. 2 is a system diagram of a turbo refrigerator in a second embodiment of the present invention.

FIG. 2 is a system diagram of a turbo refrigerator 1A in a second embodiment of the present invention. As shown in this drawing, in the turbo refrigerator 1A of this embodiment, the flow path R10, the flow path R11, the flow path R12, the flow path R13, the flow path R14, the flow path R15, the small compressor 8, the ejector 9, the sealing mechanism 38, the sealing mechanism 39, the third expansion valve 63, the fourth expansion valve 64, the flow rate adjusting valve 40, the first compressed gas supply space S6, and the second compressed gas supply space S7, which are provided in the turbo refrigerator 1 of the first embodiment, are not installed.

In this embodiment, a first orifice 65 is provided instead of the third expansion valve 63, and a second orifice 66 is provided instead of the fourth expansion valve 64. In this embodiment, the refrigerant liquid X2 flowing through the flow path R6 is decompressed in the first orifice 65 as it is a liquid, and is supplied to the motor accommodation space S3.

Furthermore, the refrigerant liquid X2 flowing through the flow path R6 is decompressed in the second orifice 66 as it is a liquid, and goes through the oil cooler 7 and is then supplied to the motor accommodation space S3. Furthermore, the refrigerant liquid X2 passes through a flow path (not shown) formed around the motor 10, thereby cooling the motor 10, and is then discharged from the motor accommodation space S3. A flow path R16 leading to the evaporator 4 is connected to the motor accommodation space S3, and the refrigerant liquid X2 is returned to the evaporator 4 through the flow path R16.

The turbo refrigerator 1A of this embodiment is provided with a small refrigerator 51 (a sub-refrigerator) which is installed at a site in the middle of the flow path R6, as shown in FIG. 2. The small refrigerator 51 is provided with a small condenser 52, a small evaporator 53, and a small compressor 54. Furthermore, the small refrigerator 51 has an expansion valve (not shown) provided between the small condenser 52 and the small evaporator 53. The small refrigerator 51 cools only the refrigerant liquid X2 which flows through the flow path R6. For this reason, the small condenser 52, the small evaporator 53, and the small compressor 54 are very small as compared to the condenser 2, the evaporator 4, and the turbo compressor 5.

Furthermore, also in this embodiment, the flow path R6 functions as the refrigerant introduction part T in the present invention, which introduces some of the refrigerant circulating between the evaporator 4 and the condenser 2 into the motor accommodation space S3 and the oil cooler 7.

In the turbo refrigerator 1A of this embodiment having such a configuration, the refrigerant liquid X2 which is introduced into the motor accommodation space S3 and the oil cooler 7 is cooled by the small refrigerator 51. Therefore, according to the turbo refrigerator 1A of this embodiment, even in a case where the temperature of the refrigerant liquid X2 in the condenser 2 is not sufficiently low, it is possible to sufficiently cool the motor 10 and the lubricating oil.

The preferred embodiments of the present invention have been described above with reference to the accompanying drawings. However, the present invention is not limited to the embodiments described above. The shapes, the combination, or the like of the respective constituent members shown in the embodiments described above are only examples, and various changes can be made based on design requirements or the like within a scope of the present invention.

For example, in the second embodiment described above, a configuration using the first orifice 65 and the second orifice 66 are described. However, an expansion valve may be used, like the first embodiment described above.

INDUSTRIAL APPLICABILITY

According to the present invention, it is possible to sufficiently cool a motor and lubricating oil in a turbo refrigerator.

REFERENCE SIGNS LIST

1, 1A: turbo refrigerator
2: condenser
2*a:* heat exchanger tube
3: economizer

4: evaporator
4*a:* heat exchanger tube
5: turbo compressor
5*a:* gas discharge pipe
5*b:* economizer connecting pipe
5*c:* gas suction pipe
6: expansion valve
7: oil cooler (oil cooling unit)
8: small compressor (cooling unit)
9: ejector
10: motor
11: first compression stage
12: second compression stage
13, 14: impeller
15: rotating shaft
16: inlet guide vane
17: outlet throttle valve
20: housing
21: bearing
22: stator
23: rotor
24: rotating shaft
25: gear unit
26, 27: bearing
28: oil tank
29: large-diameter gear
30: small-diameter gear
31: bearing
32, 33, 34: sealing mechanism
35, 36: sealing mechanism (first non-contact sealing mechanism)
37: oil feed pump
38, 39: sealing mechanism (second non-contact sealing mechanism)
40: flow rate adjusting valve
51: small refrigerator (cooling unit, sub-refrigerator)
52: small condenser
53: small evaporator
54: small compressor
61: first expansion valve
62: second expansion valve
63: third expansion valve
64: fourth expansion valve
65: first orifice
66: second orifice
R1, R2, R3, R4, R5, R8, R9, R10, R11, R12, R13, R14, R15, R16: flow path
R6: flow path (refrigerant introduction part)
S1: compression flow path space
S2: first bearing accommodation space
S3: motor accommodation space
S4: gear unit accommodation space
S5: second bearing accommodation space
S6: first compressed gas supply space
S7: second compressed gas supply space
X1: compressed refrigerant gas
X2: refrigerant liquid
X3: gas-phase component
X4, X5, X6: refrigerant gas
T: refrigerant introduction part

The invention claimed is:

1. A turbo refrigerator comprising:

a turbo compressor having a motor, an impeller which compresses a refrigerant gas by rotating by the motor, a gear unit which has a gear fixed to a rotating shaft of the motor, and a housing, the housing having a motor accommodation space in which a stator and a rotor of the motor are accommodated, a gear unit accommodation space in which the gear unit is accommodated, and a compression flow path space in which the impeller is provided;

a condenser which cools and liquefies the refrigerant gas compressed by the turbo compressor to form a refrigerant liquid, an evaporator which vaporizes the refrigerant liquid produced in the condenser to the refrigerant gas and sends the refrigerant gas to the compression flow path space, an oil cooling unit which cools lubricating oil which is supplied to a sliding site of the turbo compressor;

a refrigerant introduction part which is provided with an expansion valve decompressing the refrigerant liquid taken out from the condenser to generate the refrigerant gas and introduces the refrigerant gas produced by the expansion valve into the motor accommodation space and the oil cooling unit; and a cooling unit which is a compressor which decompresses the motor accommodation space and decompresses a space in the oil cooling unit, thereby cooling the refrigerant gas which is introduced from the refrigerant introduction part into the motor accommodation space and the space in the oil cooling unit, and recovers the refrigerant gas from the motor accommodation space and the space in the oil cooling unit and then returns the refrigerant gas to the evaporator.

2. The turbo refrigerator according to claim 1, further comprising:

an oil returning unit which returns the lubricating oil accumulated in the motor accommodation space to an oil tank in which the lubricating oil is stored.

3. The turbo refrigerator according to claim 2, wherein the oil returning unit is an ejector which moves the lubricating oil by using a compressed refrigerant gas produced by the turbo compressor.

4. The turbo refrigerator according to claim 1, further comprising:

a bearing which rotatably supports the rotating shaft of the motor;

a first non-contact sealing mechanism and a second non-contact sealing mechanism which are disposed further toward the rotor side of the motor than the bearing and arranged in an axial direction of the rotating shaft; and a compressed gas supply part which supplies some of the compressed refrigerant gas produced by the turbo compressor between the first non-contact sealing mechanism and the second non-contact sealing mechanism.

5. The turbo refrigerator according to claim 2, further comprising:

a bearing which rotatably supports the rotating shaft of the motor;

a first non-contact sealing mechanism and a second non-contact sealing mechanism which are disposed further toward the rotor side of the motor than the bearing and arranged in an axial direction of the rotating shaft; and a compressed gas supply part which supplies some of the compressed refrigerant gas produced by the turbo compressor between the first non-contact sealing mechanism and the second non-contact sealing mechanism.

6. The turbo refrigerator according to claim 3, further comprising:

a bearing which rotatably supports the rotating shaft of the motor;

a first non-contact sealing mechanism and a second non-contact sealing mechanism which are disposed further toward the rotor side of the motor than the bearing and arranged in an axial direction of the rotating shaft; and a compressed gas supply part which supplies some of the compressed refrigerant gas produced by the turbo compressor between the first non-contact sealing mechanism and the second non-contact sealing mechanism.

* * * * *